United States Patent [19]

Grau

[11] Patent Number: 4,861,252

[45] Date of Patent: Aug. 29, 1989

[54] VIBRATOR TYPE CONCRETE PIPE MAKING MACHINES HAVING COMBINED LUBRICATION AND COOLING SYSTEM

[75] Inventor: Thomas D. Grau, Sioux City, Iowa

[73] Assignee: International Pipe Machinery Corp., Sioux City, Iowa

[21] Appl. No.: 253,365

[22] Filed: Sep. 29, 1988

Related U.S. Application Data

[63] Continuation of Ser. No. 906,044, Sep. 11, 1986, abandoned.

[51] Int. Cl.[4] ..... B28B 21/16

[52] U.S. Cl. ..... 425/135; 184/6.1.; 184/6.4; 184/6.22; 366/128; 384/316; 425/151; 425/161; 425/432; 425/456

[58] Field of Search ..... 425/135, 151, 161, 262, 425/404, 424, 432, 456; 366/128; 384/313, 316; 184/6.1, 6.3, 6.4, 6.22

[56] References Cited

U.S. PATENT DOCUMENTS

| | | | |
|---|---|---|---|
| 2,679,384 | 5/1954 | Livingston et al. | 366/128 |
| 2,809,078 | 10/1957 | Hartwig | 384/316 |
| 3,177,554 | 4/1965 | Lärkfeldt | 366/128 |
| 3,698,514 | 10/1972 | Buck et al. | 384/313 |
| 3,948,354 | 4/1976 | Fosse et al. | 425/456 |
| 4,288,165 | 9/1981 | Fewel | 366/128 |
| 4,400,149 | 8/1983 | Toffolon et al. | 425/432 |
| 4,435,083 | 3/1984 | Matson | 366/128 |
| 4,587,863 | 5/1986 | Wadensten | 366/128 |

FOREIGN PATENT DOCUMENTS

| | | | |
|---|---|---|---|
| 423056 | 1/1935 | United Kingdom | 384/313 |

*Primary Examiner*—James Housel
*Attorney, Agent, or Firm*—Baker & McKenzie

[57] ABSTRACT

A vibrating type concrete pipe making machine, in which very high frequencies of vibration and large inputs may be attained without excessive wear on the mold or shortened bearing life. It also includes lubricant and coolant systems which are combined into a single system.

3 Claims, 6 Drawing Sheets

VIBRATOR TYPE CONCRETE PIPE MAKING MACHINES HAVING COMBINED LUBRICATION AND COOLING SYSTEM

This application is a continuation of application Ser. No. 906,044, filed Sept. 11, 1986, now abandoned.

This invention relates generally to concrete pipe manufacturing machines having vibration systems, and specifically to such equipment having exceedingly high vibrating energy level inputs which maintain the amplitude of vibration, and hence the flexing of the mold core, at a very low, non-destructive level which in turn results in a virtual absence of fatigue stress on the mold core. The invention includes a long life vibrator system which operates substantially maintenance free, said system being characterized by having vibrator lubricating and cooling systems combined into a single, dual purpose system within the hydraulic vibrator. The invention also relates to a method of operation of a vibratory type densification system at impacts substantially greater than those currently available.

SUMMARY OF THE INVENTION

Internal hydraulic vibrators are used in dry cast systems for secondary densification and general product quality improvement. This improvement in quality has a cost, however, in that maintenance problems have been encountered with vibrator systems heretofore employed, particularly hydraulic type systems. Such prior systems have required a water cooling jacket on the vibrator due to the use of a dip oil lubrication system in the vibrator. This separate cooling system can be the cause of maintenance problems.

Air, electric and hydraulic vibrators are known in the art. Air vibrators are known which operate at frequencies of up to 10,000 rpm's per minute. Such vibrators do not, however, provide the necessary energy for many applications. Electric vibrators at this time are universally limited to a vibration frequency of 3,450 rpm due to the necessity to achieve a mechanical and economical balance between competing factors. Hydraulic systems have, to this time, been limited to relatively low frequencies and amplitudes of vibration because such vibrators have generated an unacceptably high amplitude at high energy input levels. It will be understood that high amplitudes result in excessive flexing of the inner mold core—up to 0.125" for example—which results in heavy fatigue stresses in the metal of the core, and eventual failure before an economically acceptable life span can be achieved. Such high energy level inputs also have invariably been a cause of early bearing failure, and hence the art currently does not favor frequencies much greater than about 3,500 rpm. At this level, the impact energy is limited when the fatigue life of the inner core and the bearing life of the vibrator are considered.

The present invention includes a hydraulic vibrator system which can operate in the range of from 3,000 to 10,000 rpm, though a range of 3,000 to 6,000 is preferred, with input energy of up to 50,000 pounds without placing excessive fatigue stresses on the inner mold core and virtually eliminating bearing failure attributable to operating at such high frequencies and energy levels. A significant feature of the invention is a combined pressurized lubrication and cooling system, said system being arranged within a housing of the hydraulic vibrator. The above arrangement may be incorporated in vibrators which have infinitely variable impacts of up to 48,000 pounds which are, so far as the combined lubrication and cooling system is concerned, maintenance free.

Accordingly, a primary object of this invention is to provide a vibrator type concrete pipe making machine which has high frequencies of vibration and high energy level inputs and yet is substantially maintenance free.

A further object is to provide a hydraulic vibrator for a concrete pipe making machine which is capable of operating normally at high frequencies of vibration and high energy input levels; indeed, considerably higher than existing systems, and yet is substantially maintenance free.

Another object is to provide such a hydraulic vibrator in which the internal lubrication and cooling systems are combined into one system.

Yet a further object is to provide a method of subjecting cast concrete products to densification treatment by hydraulic vibration means in which the impact mechanism is simultaneously lubricated and cooled by a single source of pressurized fluid.

A further object is to provide a vibrator type concrete pipe making machine in which frequencies of vibration of up to 10,000 per minute and energy levels of up to 50,000 pounds induce amplitudes of oscillation of no more than about 0.015" to about 0.035" in the inner wall of the mold without bearing failure.

Other objects and advantages of the invention will become apparent from a reading of the following exemplary description of a specific embodiment thereof.

DESCRIPTION OF THE DRAWING

The invention is illustrated more or less diagramatically in the accompanying drawing wherein.

DETAILED DESCRIPTION

Figure 1:
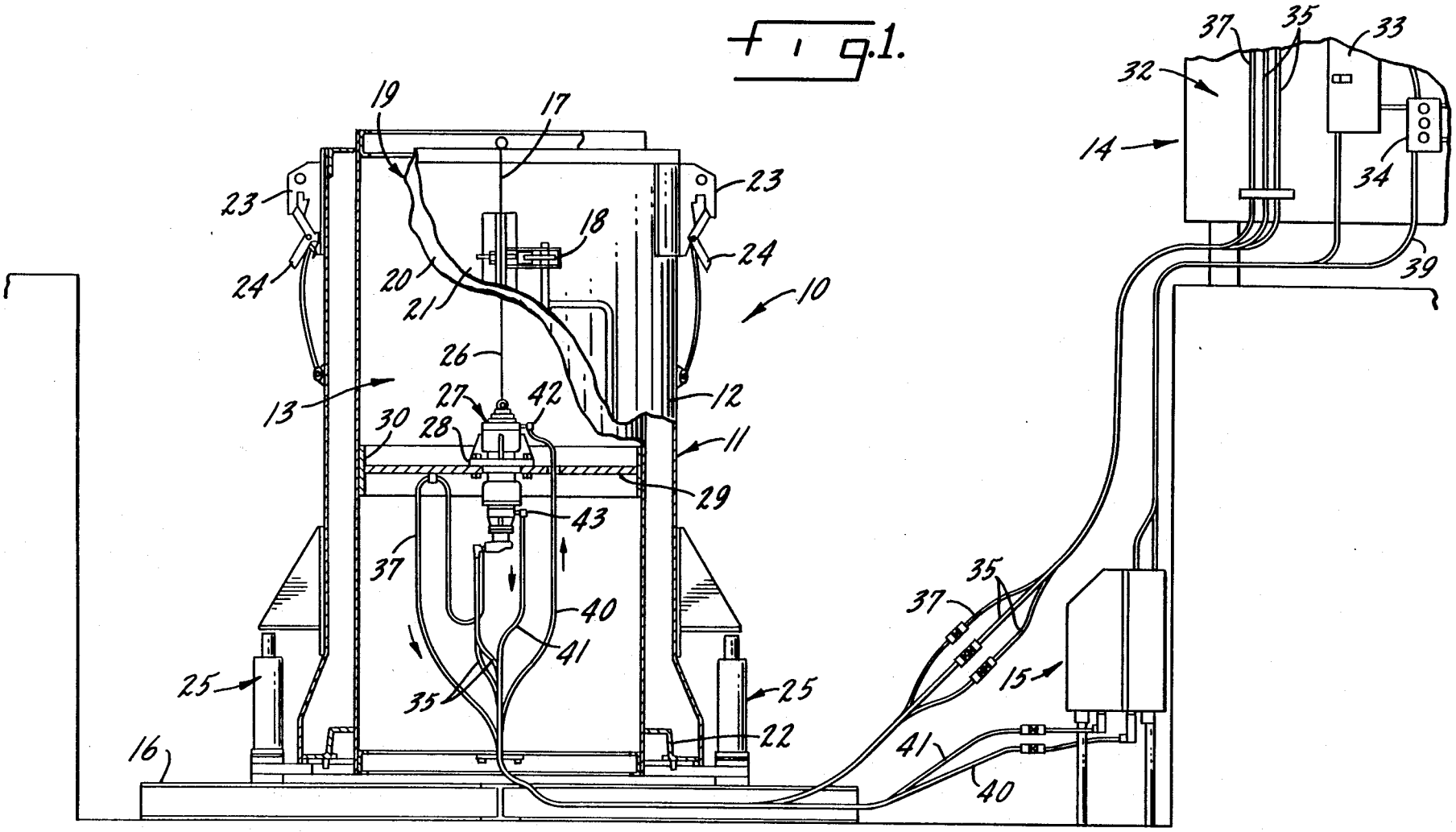
FIG. 1 is a schematic elevation with parts broken away for clarity of a dry cast concrete pipe making machine in which the invention of this application is incorporated.

Like reference numerals will be used to refer to like parts from figure to figure in the drawing.

Referring first to FIG. 1, a dry cast concrete pipe making machine is indicated generally at 10. The machine includes a mold assembly, indicated generally at 11, which in turn consists of a mold 12, an internal hydraulic vibrator unit indicated generally at 13, a vibrator power unit indicated generally at 14, and a vibrator lubrication and cooling unit indicated generally at 15. It will be noted that the vibrator power unit 14, which generates hydraulic pressure fluid for operating a hydraulic motor, later described, to power the vibrator, is mounted at a higher elevation than the hydraulic vibrator unit 13.

Mold 12 is supported on a base 16 of any suitable configuration. The mold is of the clam shell type with a parting line at 17 and clamping means 18. The core, indicated generally at 19, of the mold consists essentially of inner and outer walls or cylinders, 20, 21, respectively, which form therebetween a mold for the reception of the concrete material of which the product is to be composed. In this instance, a bell end down mold has been disclosed. A curing pallet is indicated at 22, lift handles at 23, and a safety lock bar for each lift handle at 24. Mold strip assist means are indicated generally at 25.

The internal hydraulic vibrator unit 13 includes a hydraulic vibrator, indicated generally at 27, which is bolted via a flange plate 28 to a platen 29 which in turn has a peripheral flange 30 in contact with inner wall 20 of the core 19. It will be understood that impacts generated by the hydraulic vibrator 27 will be transmitted via the flange plate 28, platen 29, and peripheral flange 30 to the inner wall 20 of the core 19 and, thereby, to the cast product which is confined between the inner and outer walls 20 and 21.

The vibrator power unit 14 provides pressurized hydraulic fluid to operate the hydraulic vibrator 27. The vibrator power unit 14 includes a source of hydraulic pressure fluid, indicated generally at 32, a power source such as an electric motor driving a pump, shown in FIG. 8, to generate pressure from the pressure source 32, a starter 33, and a junction box 34 which contains suitable electrical controls.

Hydraulic fluid under pressure is conveyed by vibrator pressure lines 35 to a hydraulic motor 36 located at the bottom of the hydraulic vibrator unit 27. A drain or return line is indicated at 37.

Figure 2:
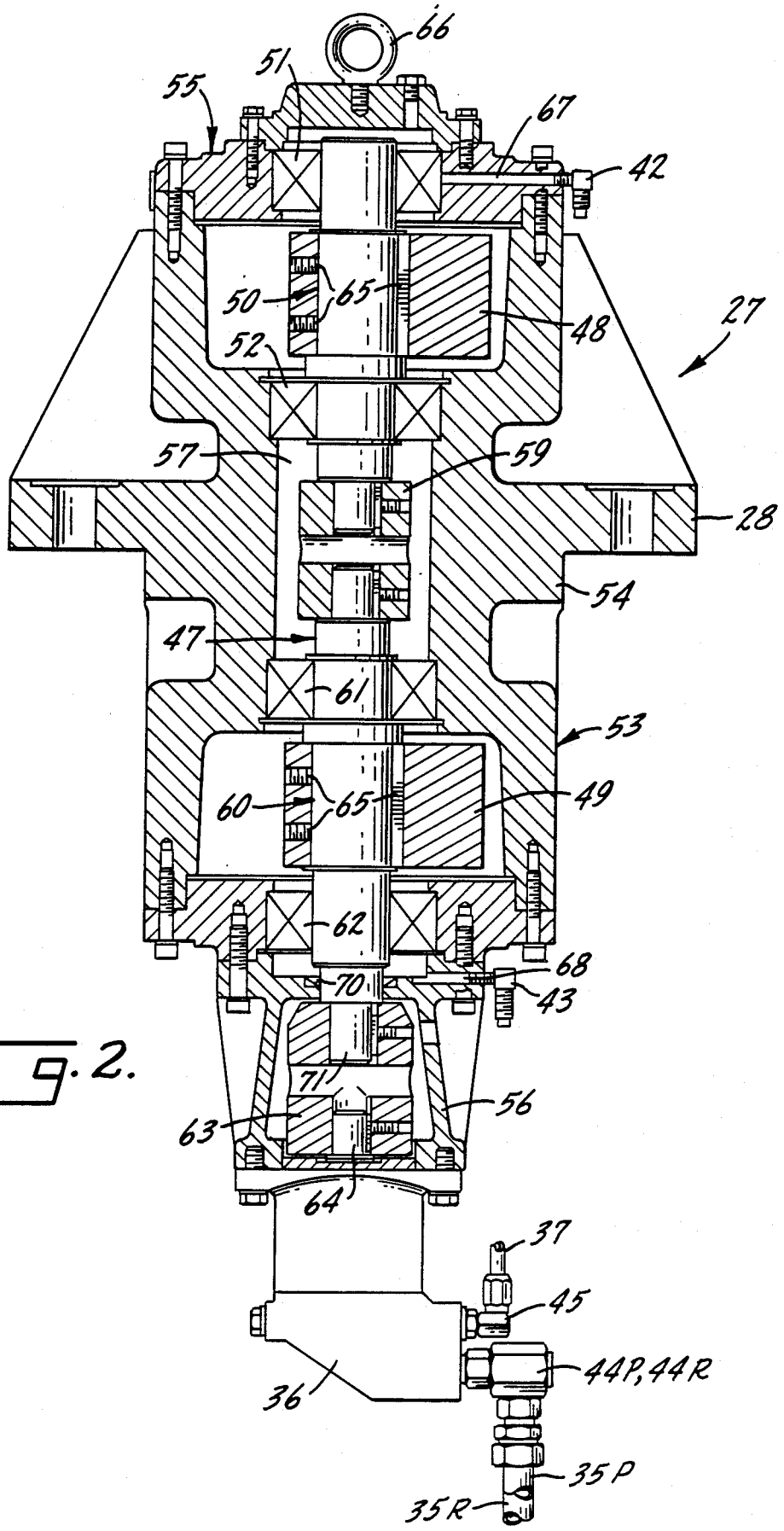
FIG. 2 is a section through the hydraulic vibrator in the concrete pipe making machine of FIG. 1.
Figure 3:
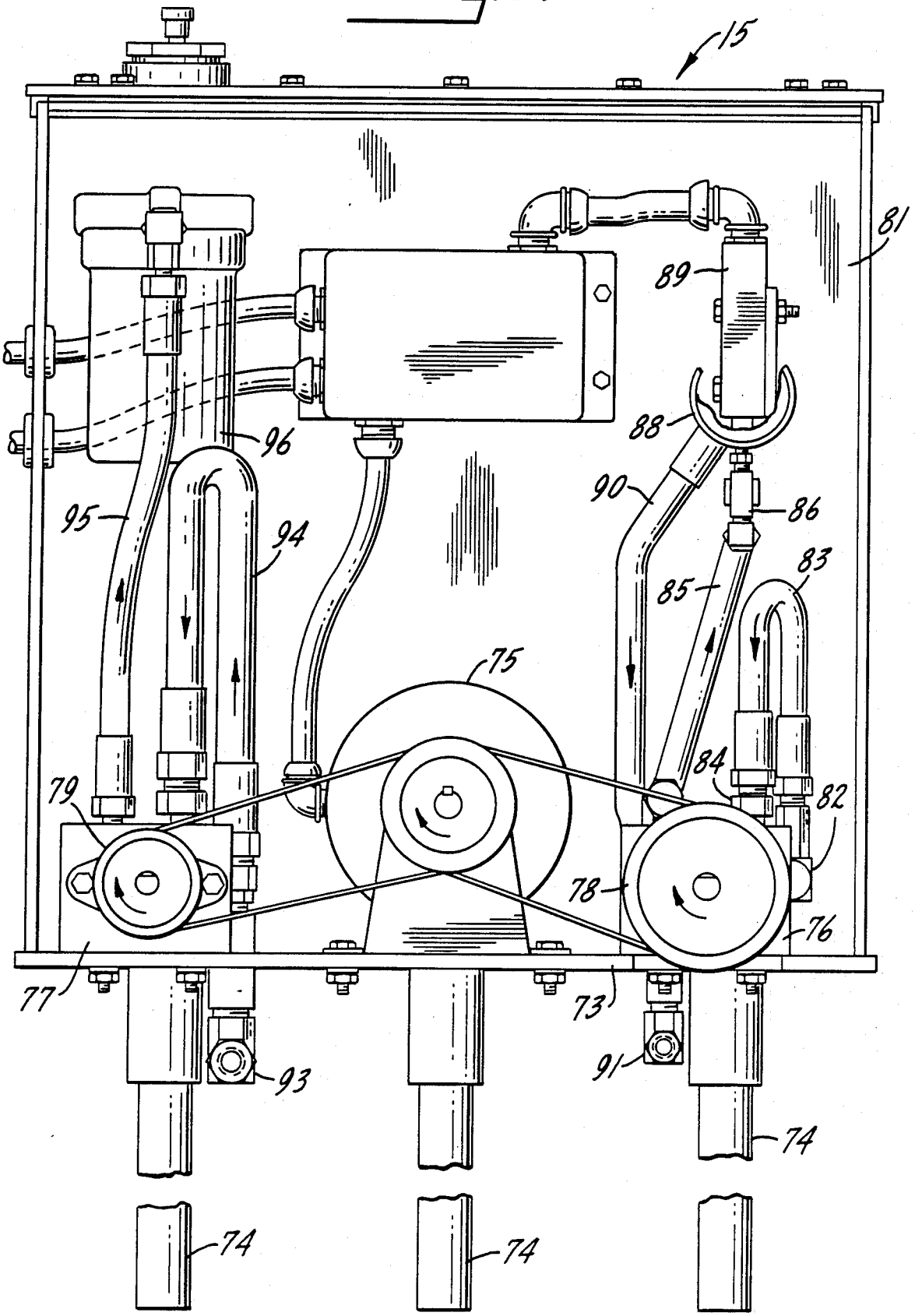
FIG. 3 is a front view of the combined lubrication and cooling systems for the hydraulic vibrator with parts omitted and others partially broken away for clarity.
Figure 4:
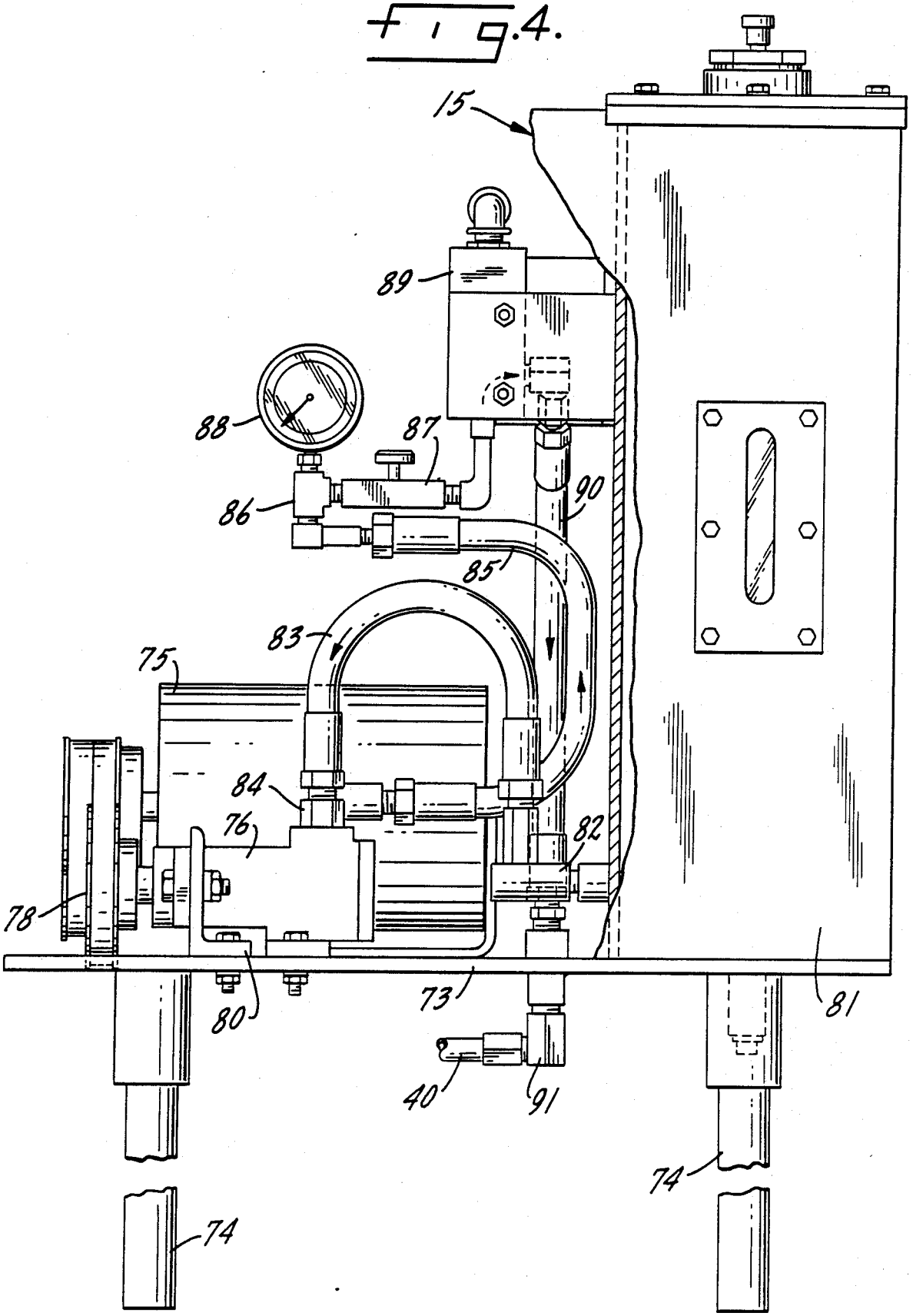
FIG. 4 is a right side view of the combined lubrication and cooling systems for the hydraulic vibrator with parts broken away for clarity.
Figure 5:
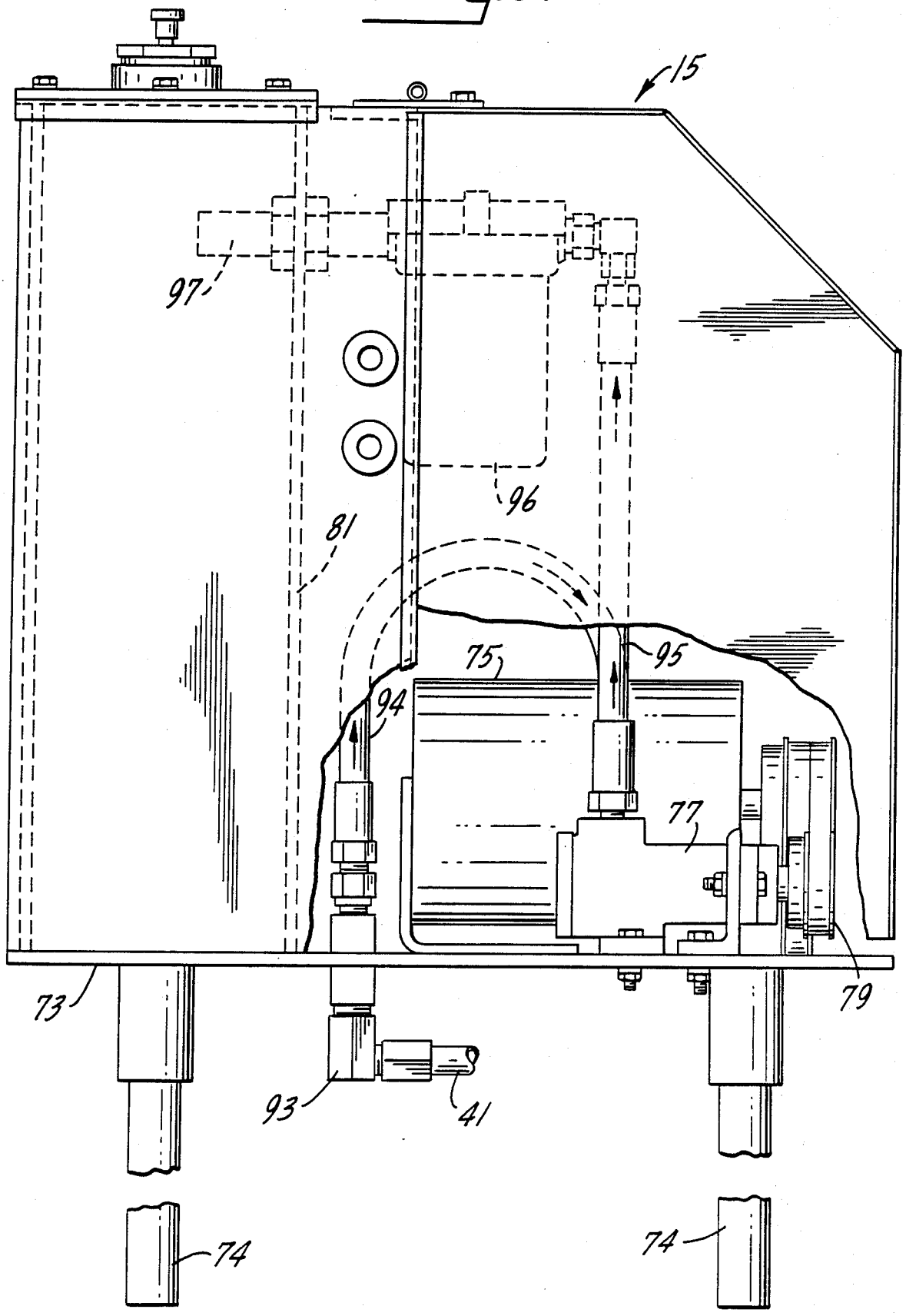
FIG. 5 is a left side view of the combined lubrication and cooling systems for the hydraulic vibrator with parts omitted for clarity.

The combined hydraulic vibrator lubricant and cooling unit 15 includes a suitable electric motor and pumps, see FIGS. 3–5, which is controlled via control cable 39 which connects the unit to the junction box 34. A pressure line is indicated at 40 and a return line at 41. It will be noted that the pressure line connects to the inlet connector 42 at the top of the hydraulic vibrator unit 13, and the drain line connects to an outlet 43 at the bottom of the shaft means, to be hereinafter described, in the hydraulic vibrator unit, all as shown best in FIGS. 1 and 2.

The pressure system for the hydraulic motor for operating the vibrator is shown best in FIG. 1.

Hydraulic fluid from vibrator pressure line enters the hydraulic vibrator unit 13 at pressure inlet 44P which, in this instance, is illustrated as a swivel union in order to accommodate reception of the pressure fluid from any direction and to compensate for vibration failure which would result from a rigid connection. A second, identical connector, 44R, which lies just behind 44P, functions to return fluid which has passed through hydraulic motor 36 to the power unit. The suffixes "P" and "R" designate pressure and return respectively. As will be apparent hereinafter, and particularly from FIG. 3, each line has a pump associated with it since it is necessary to apply pressure to the fluid as it exits the hydraulic motor to preclude undesirable accumulation in the motor. Pressure fluid flows via pressure line 35P to the inlet connector 44P of the hydraulic motor 36 and exits from pressure outlet 44R from whence it returns to the vibrator power unit 14 via return line 35R. A case drain line 37, which is connected to motor 36 at 45, is looped at an elevation above the motor 36 to maintain proper oil level and lubrication in the motor housing and drains back to the hydraulic reservoir 32 of power unit 14. The hydraulic motor 36 turns the shaft means, indicated generally at 47, which carries the eccentrics 48 and 49. As best illustrated in FIG. 2, the shaft means consists of a top shaft section, indicated generally at 50, the end portions of which are journalled in end bearings 51 and 52. It will be understood that the bearings are retained by spacers and snap rings which maintain the illustrated, fixed relationship between the bearings and the housing which is indicated generally at 53. Housing 53, which includes central section 54, top end plate assembly 55, and bottom extension 56, forms an internal chamber, indicated generally at 57, within which the shaft means and its associated eccentrics rotate.

Top shaft section 50 is connected via connector 59 to bottom shaft section 60 which in turn is journalled in end bearings 61, 62. Bottom shaft section 60 carries eccentric 49. The bottom shaft section is connected by connector 63 to the output shaft 64 of the hydraulic motor 36.

As illustrated, each eccentric 48 and 49 is fixedly secured to the shaft means by both keys and set screws 65.

Means for enabling the entire hydraulic vibrator unit to be raised and lowered within a mold is indicated at 66, which in this instance is an eye bolt integral with the housing 53 and suitable for connection to a conventional lifting and lowering apparatus, such as a winch and cable 26, which is conventional in the art.

Extra pressure lubricant and coolant fluid enters the chamber 57 through inlet connector 42 and passage 67 which terminates at bearing 51. The extra pressure lubricant lubricates and cools bearing 51 and then passes downwardly through the housing past eccentric 48, to bearing 52, which is lubricated and cooled as the extra pressure lubricant flows past. The extra pressure fluid then moves into the lower section of the housing where it lubricates and cools bearings 61 and 62 before exiting through passage 68 and outlet connector 43. Seal means 70 precludes leakage of the combination lubricant and coolant fluid past the reduced end portion 71 of bottom shaft section 60. Similar seal means associated with hydraulic motor 36 precludes leakage of the high pressure operating fluid which enters or leaves via connector 44P and 44R from leaking past the power output shaft 64 of the hydraulic motor. Thus, the combined lubricant and coolant system pressure path and the hydraulic motor pressure fluid path are separate during operation.

Suitable interlock means preclude the hydraulic motor from operating until the combined lubricant and coolant system pressure system is operational, said system including a flow sensing device in the combined lubricant and coolant system circuit which, when indicating normal conditions, enables a circuit to be completed in the control system for the hydraulic motor.

The combined lubricant and coolant system unit 15 is illustrated best in FIGS. 3, 4 and 5.

Referring first to FIG. 3, the bottom plate of a tank is indicated at 73 supported by legs 74. The legs are adjustable to insure that the bottom plate 73 can be maintained level. An electric motor is indicated at 75, the motor driving two pumps 76, 77, through pulleys 78, 79, respectively.

Referring now to FIG. 4, it will be noted that pressure pump 76 is secured to bottom plate 73 of the tank by bracket 80. The combined lubricant/coolant fluid flows from tank 81 through connector 82 and loop 83 to the inlet port 84 of pump 76. The fluid under pressure leaves pump 76 through loop 85 and passes through tee 86 and flow control 87. A pressure gauge is indicated at 88. The high pressure fluid then passes through flow switch 89 and thence flows downwardly through conduit 90 to the pressure outlet port 91 which connects with pressure line 40 which in turn transmits the combined lubricant and coolant fluid to the hydraulic vibrator at inlet connector 42.

As best seen in FIG. 5, the combined lubricant and coolant fluid which is drained from the hydraulic vibrator 27 through line 41 enters the lubrication and cooling unit 15 through inlet connector 93 from whence it passes via loop conduit 94 to the inlet port of suction pump 77. After passing through pump 77, the fluid exits via line 95 to filter assembly 96 from whence it is discharged via filter outlet connector 97 into tank 81 where it may again circulate through the system.

Since the circuit for conducting high pressure fluid from the vibrator power unit 14 through the hydraulic motor 36 of the vibrator unit 27 is conventional, it is not further described herein.

Figure 6:
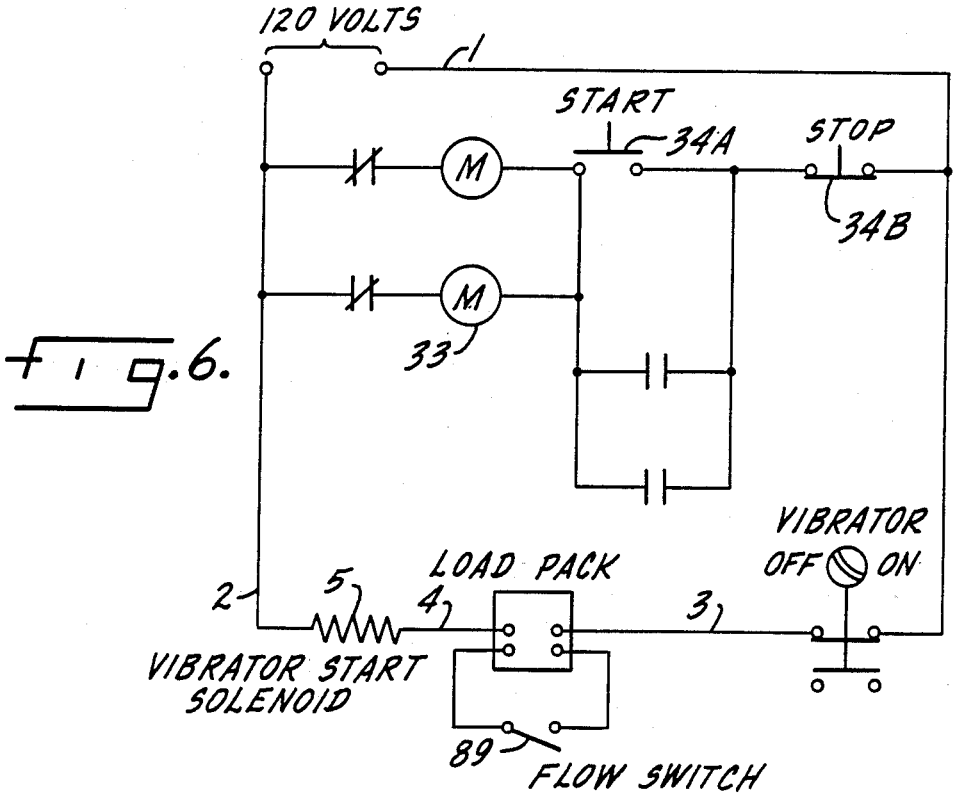
FIG. 6 is a schematic view of the hydraulic controls.
Figure 7:
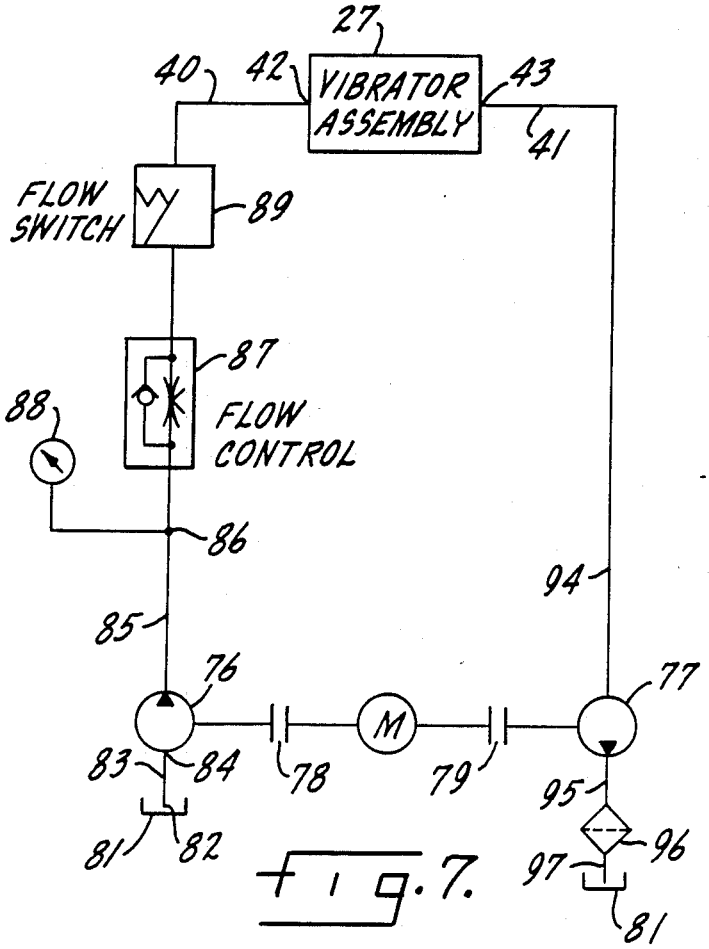
FIG. 7 is a schematic view of the hydraulic circuit for the vibrator lubrication and cooling system.
Figure 8:
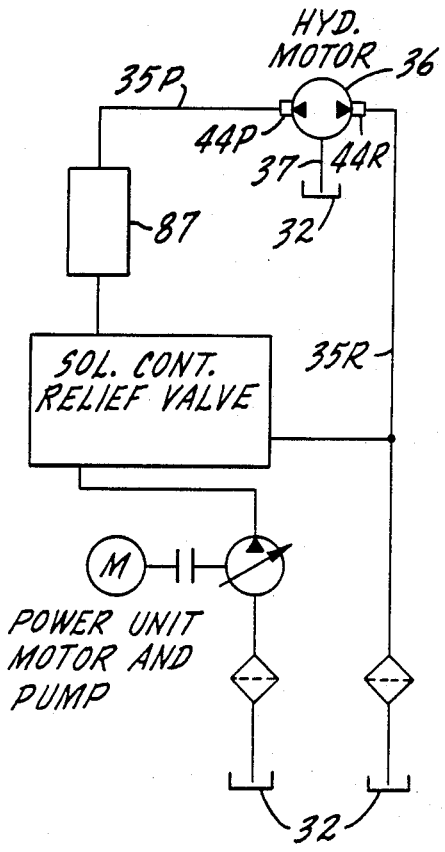
FIG. 8 is a schematic view of the electric circuit for the hydraulic drive system for the vibrator.

Referring now to FIGS. 6, 7 and 8, the operating and primary safety features of the system are illustrated.

Referring now to FIG. 6, start pushbuttom 34A energizes both the power unit motor and the lubrication unit motor 33.

Selector switch 34C operates the vibrator. To turn the vibrator on this selector is positioned to the on position and the contacts close, connecting the electric circuit between power supply wire 1 and wire 3.

If proper flow of lubrication and cooling fluid exists the flow switch 89 will close the contacts in the load pack and complete the electrical circuit between wire 3 and wire 4.

If the above circuits are complete, the vibrator start solenoid 5, which is connected between wire 4 and power wire 2, will be energized.

Referring now to FIG. 7, motor 75 is turned on upon initial start up of the system and remains operating continuously during the pipe production period. Motor 75 drives pump 76 and 77 through drive belts and gear pulleys 78 and 79 respectively as earlier described.

Positive displacement pump 76 receives extra pressure lubricant and cooling fluid from reservoir 81 via fitting location 82, hose 83, and inlet pump connection 84.

Pump 76 then supplies pressurized lubrication and cooling oil to the system. The desired discharge flow from the pump is adjucted by means of the flow control valve 87 and the excess flow supplied by the pump is discharged back into reservoir 81 through hose 83 by means of an internal pressure relief valve built into the pump 76.

The proper amount of fluid then flows through the flow switch 89. Inadequate flow through this switch will result in an open circuit in the vibrator control circuit and not allow the vibrator to operate, thereby preventing possible damage to system.

The fluid then flows through line 40 and connects to the vibrator at connection 42 as shown in FIGS. 1 and 2.

The lubrication and cooling fluid then flows down through the vibrator as shown in FIG. 2 by gravity allowing the vibrator bearings to run at high revolutions per minute without damage. As a result, normal operating speeds can be as high as 6,000 rpm without damage to the vibrator and operating speeds up to 10,000 rpm are possible, at least for short periods.

Suction pump 77 removes any accumulation of fluid inside the vibrator housing and pumps it through filter 96 and back into reservoir 81.

The system operates continuously during pipe production operation so it can lubricate and cool independently of vibrator operation.

In FIG. 8, which is the hydraulic schematic for operating the drive motor, the power unit motor and pump operate continuously during production. When densification of concrete is required, the vibrator control selector 34C is turned to the on position. If lubrication and cooling is occurring properly the result is the closure of flow switch 89 and the vibrator start solenoid will energize and cause high pressure hydraulic fluid to flow through the vibrator speed control valve. The pressure and temperature compensating vibrator speed control valve maintains the vibrator frequency to the desired level for proper vibration force and amplitude to densify the desired product size. The hydraulic oil then flows through line 35P and connects to motor 36 at fitting 44P and exits the motor at connection 44R. The oil then returns through line 35R through the return filter back to the reservoir 32.

The use and operation of the invention is as follows.

Shortly after commencement of pouring mold 12 with concrete, the internal hydraulic vibrator unit 13 is activated and operates during filling to obtain the properly densified product.

The combined lubricant and coolant system is first activated by the operator who controls the junction box 34 at the operator's station. The vibrating unit continues to run during the pipe making process. Indeed, preferably, it runs continuously. The operator first activates the vibrator lubricant and coolant unit 15 to cause fluid under pressure, as above described, to enter the hydraulic vibrator 27 at inlet connector 42, from whence it flows, as above described, through the unit to the outlet connector 43 and thence via return line 41 to the lubricant and coolant unit 15 in which the pressure is maintained by pressure line pump 76. Simultaneously, of course, pump 77 pulls the lubricant and coolant fluid which has passed through the internal chamber 57 in housing 53 and exited at outlet connector 43 through return line 41, sends it through the filter assembly 96, and thence into reservoir 81 from which it may then be drawn via connector 82 into the pressure loop of the system.

The system is so arranged that the combined lubricant and coolant system must be operative, and in normal condition, before the vibrator power unit 14 is activated to operate hydraulic motor 36 which turns the shaft means 47 on which the eccentrics 48 and 49 are located. Thus, there is no possibility of the shaft means and bearings operating in the absence of a lubrication and cooling fluid.

By proper sizing of the components, it is possible to generate impact forces infinitely variable basis from 0 up to almost 50,000 pounds without imposing larger than conventional fatigue stresses on mold core 20 with maintenance free operation and particularly long bearing life. By using high frequencies, the amplitude of vibration can be maintained in the range of about 0.015" to 0.035" which is not sufficient to induce fatigue failure in the type of steel currently widely used in the core. It now appears that frequencies in the range of 3,000 to 6,000 per minute are exceedingly safe, and accordingly this is the generally preferred range. In some applications, frequencies of up to 10,000 per minute may be used without detrimental effect on the mold core or vibrator bearings. At the same time, large vibrators may be used without fear of overloading the bearings because of the combined lubricant and cooling system above described.

Although a specific embodiment of the invention has been illustrated and described, it will be understood that variations may be made within the spirit and scope of the invention. Accordingly, it is intended that the scope of the invention be limited solely by the scope of the hereinafter appended claims, when interpreted in light of the relevant prior art, and not by the foregoing exemplary description.

I claim:

1. In combination, a dry cast concrete pipe making machine having a generally vertically oriented, generally cylindrical mold, a hydraulic vibrator assembly for secondary densification of material cast in the mold, and means for vertically traversing the hydraulic vibrator assembly within the mold, said hydraulic vibrator assembly including an impact platen and a hydraulic vibrator mounted on the impact platen said hydraulic vibrator including impact means mounted on shaft means for producing impact vibrations upon movement of the shaft means, a housing having an internal chamber for receiving said impact means and shaft means, said chamber extending substantially from end to end of the housing, bearing means within the housing for supporting the shaft means, said housing completely enclosing said shaft means and bearing means, hydraulic motor means associated with said housing and arranged to drive the shaft means, said hydraulic motor means having pressure inlet means and pressure drain means connected to a source of hydraulic vibrator actuating pressure fluid and a return line, respectively, and a combined lubrication and coolant system, said combined system including a source of pressurized lubricant/coolant fluid, pressure conduit means for conveying said fluid under pressure from said source to the housing, lubricant/coolant inlet means associated with the housing for admitting said fluid under pressure to the chamber, lubricant/coolant outlet means associated with the housing for draining said fluid from the chamber after flowing through the chamber and return conduit means for returning drain fluid to the source of pressurized lubricant/coolant fluid, and means for maintaining the hydraulic vibrator actuating pressure fluid and the pressurized lubricant/coolant fluid isolated from one another at all times, and means for precluding the start up of the vibrator actuating hydraulic system unless the combined lubricant/coolant is operating under pressure.

2. The apparatus of claim 1 further characterized in that the lubricant/coolant inlet means is arranged in an upper portion of the housing whereby pressurized fluid flow through the housing is in a generally downward direction.

3. The apparatus of claim 1 further characterized in that the impact means includes a plurality of eccentric weights, each eccentric weight being carried by a shaft section journaled, at each end, in a bearing, and connector means which integrally connect the shaft sections to thereby form the shaft means, all of said bearings being constructed and arranged to permit lubricant/coolant fluid to pass therethrough toward said lubricant/coolant outlet means in a quantity sufficient to maintain said bearings at a desired operating temperature.

* * * * *